US005667070A

United States Patent [19]

Miret

[11] Patent Number: 5,667,070

[45] Date of Patent: Sep. 16, 1997

[54] DEVICE FOR CARRYING CONTAINERS

[75] Inventor: Emili Requena Miret, Barcelona, Spain

[73] Assignee: Riverwood International Corporation, Atlanta, Ga.

[21] Appl. No.: 411,591

[22] PCT Filed: Oct. 4, 1993

[86] PCT No.: PCT/GB93/02059

§ 371 Date: May 15, 1995

§ 102(e) Date: May 15, 1995

[87] PCT Pub. No.: WO94/07760

PCT Pub. Date: Apr. 14, 1994

[30] Foreign Application Priority Data

Oct. 7, 1992 [GB] United Kingdom ..... 9221120

[51] Int. Cl.[6] ..... B65D 71/00

[52] U.S. Cl. ..... 206/427; 206/153; 206/158; 294/87.2

[58] Field of Search ..... 206/153, 162, 206/170, 173, 187, 193, 139, 141, 145, 152, 147–149, 158, 175, 199, 427; 294/87.2, 87.26

[56] References Cited

U.S. PATENT DOCUMENTS

| | | | |
|---|---|---|---|
| 2,222,211 | 11/1940 | Arneson | 206/170 |
| 3,161,344 | 12/1964 | Spery | 206/162 |
| 4,218,086 | 8/1980 | Klygis . | |
| 4,244,617 | 1/1981 | Manizza | 206/153 |
| 4,326,628 | 4/1982 | Wood . | |
| 5,273,156 | 12/1993 | Harris | 206/153 |

FOREIGN PATENT DOCUMENTS

| | | | |
|---|---|---|---|
| 2026424A | 5/1979 | United Kingdom | B65D 71/00 |
| 2038764A | 12/1979 | United Kingdom | B65D 71/00 |
| 2199553A | 1/1987 | United Kingdom | B65D 71/00 |

*Primary Examiner*—Paul T. Sewell
*Assistant Examiner*—Luan K. Bui
*Attorney, Agent, or Firm*—Isaf, Vaughan & Kerr; James F. Vaughan; Charles H. Fails

[57] ABSTRACT

The bottle carrying device 11 has a base 16 and angled side walls 19, 20 with handle portions 23, 24 secured by panel 26. Cuts are made in the base 16 so as to form flaps 28 which are hingedly connected to the side walls 19, 20. The flaps 28 together with edges 32 of cap holes 31 engage below the neck shoulder 15 of a bottle 12 to retain the bottle in the device 11.

14 Claims, 3 Drawing Sheets

DEVICE FOR CARRYING CONTAINERS

FIELD OF THE INVENTION

This invention relates to a device for carrying two or more containers each having an annular shoulder. One particular but not exclusive application is in the carrying a number of PET (Polyethyleneterephthalate) bottles containing beverages.

SUMMARY OF THE INVENTION

According to a first aspect of the present invention there is provided a carrier device for carrying two or more containers each having an annular shoulder projecting from the neck portion, said carrier device being formed from paperboard and comprising a base having two or more apertures for receiving the respective neck portions of the containers, two side walls which in use are angled relative to the base and extend toward each other from opposite sides of the base, a cut away portion being formed for each container in each side wall such that opposite side portions of an annular shoulder of a container are a snap fit between a cooperating pair of cut away portions, each aperture being defined at least in part by a pair of oppositely disposed flaps hingedly connected at the junction of the base and the respective side walls, which flaps in use are folded upwardly to be disposed against the respective side walls, said annular shoulder also being a snap fit above said pair of flaps. In some embodiments of the invention at least parts of the periphery of the aperture engage the container.

Preferably each aperture is generally circular and each flap is generally semi-circular having a straight edge opposite the diametral edge, which straight edge constitutes the hinge line of the flap. In preferred embodiments the distance between the hinge and the diametral edge of each flap is such that when folded back against the side wall it just protrudes above the active edge of its associated cut away portion in the side wall and the active edge of each cut away portion is constituted by an edge generally parallel to the side wall/base junction which edge has generally upwardly angled end portions.

In further preferred embodiments of the inventions the side walls are hingedly connected to upwardly projecting handle portions which incorporate a handle. Conveniently the cut away portions of the side walls extend into the handle portions to accommodate the container caps. In addition the handle portions may be glued together immediately above the hinge line with the side walls. A further securing flap extending from one handle portion and folded over the free edge of the other handle portion and adhesively secured thereto may also be provided.

In one embodiment the handle is formed by cutting out slot-shaped elements which remain hingedly connected to the handle portion along an upper edge which is generally parallel to the hinge between the handle portions and the side walls. Preferably the handle aperture and cut out elements are located and dimensioned such that when in use the handle portions can be folded down so as to lie adjacent one side wall, the cut out elements being a snap fit below the annular shoulders of the containers.

The base may also have a central, lengthwise extending fold to enable the device to be stored flat. Another preferred feature is that the grain of the paperboard extends in a direction perpendicular to the hinge lines, thus improving the strength of the device.

Accordingly, a second aspect of the present invention is provided by a paperboard blank for forming the device described above.

BRIEF DESCRIPTION OF THE DRAWINGS

Embodiments of the invention will now be described in more detail. The descriptions makes reference to the accompanying drawings in which.

DETAILED DESCRIPTION

Figure 1:
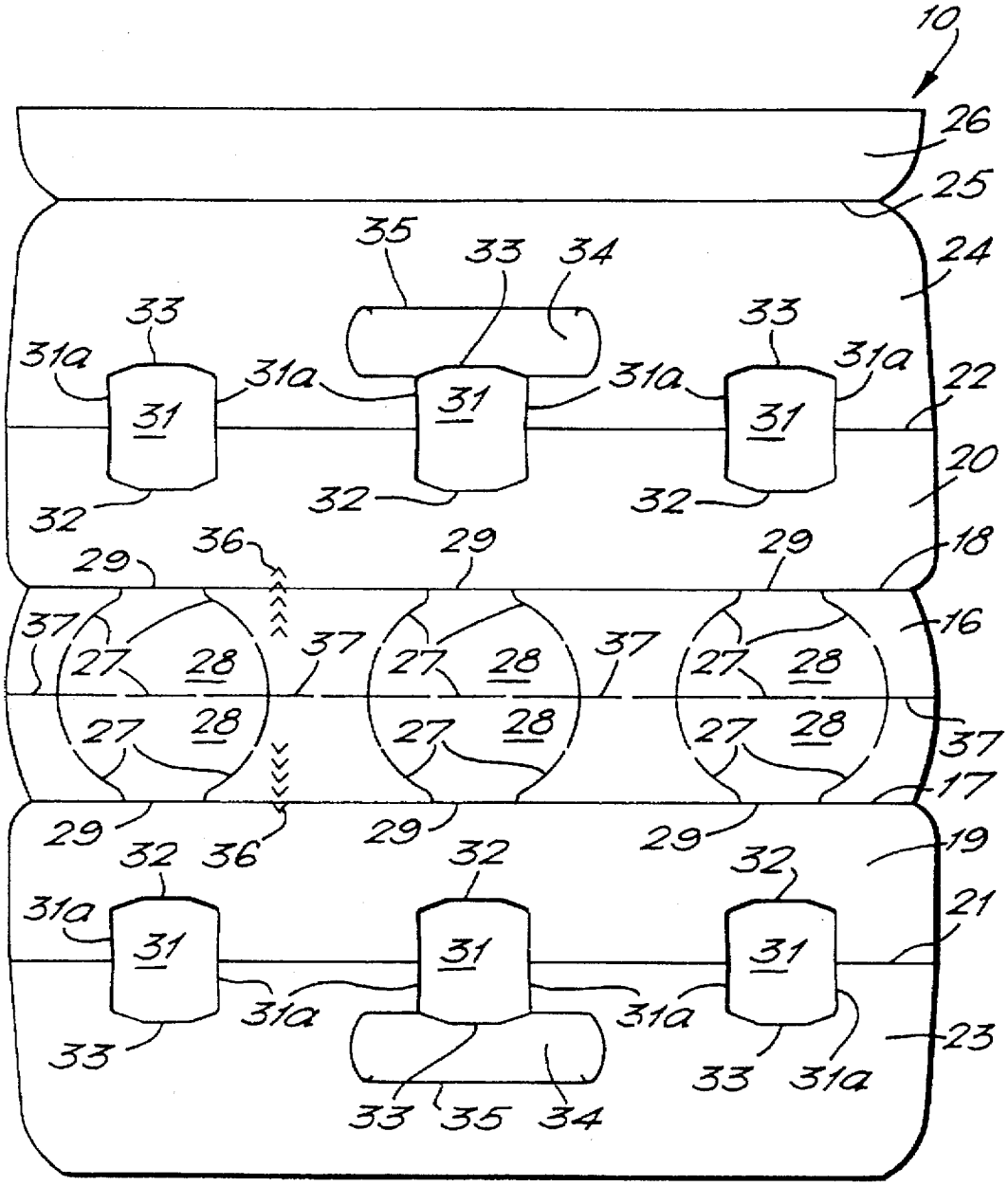
FIG. 1 shows a preferred embodiment of a carrier of the present invention.
Figure 2:
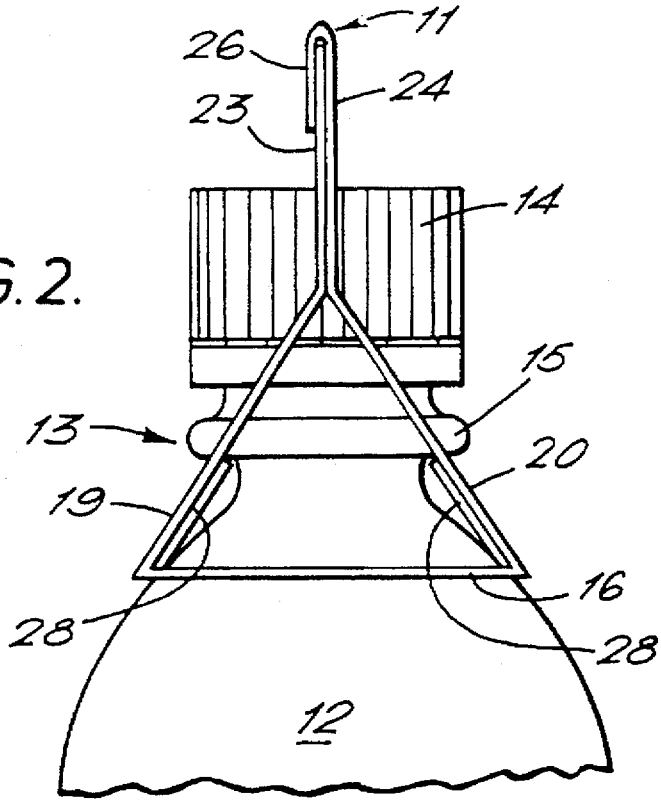
FIG. 2 is an end view of the carrier blank of FIG. 1 formed into a carrier device.
Figure 3:
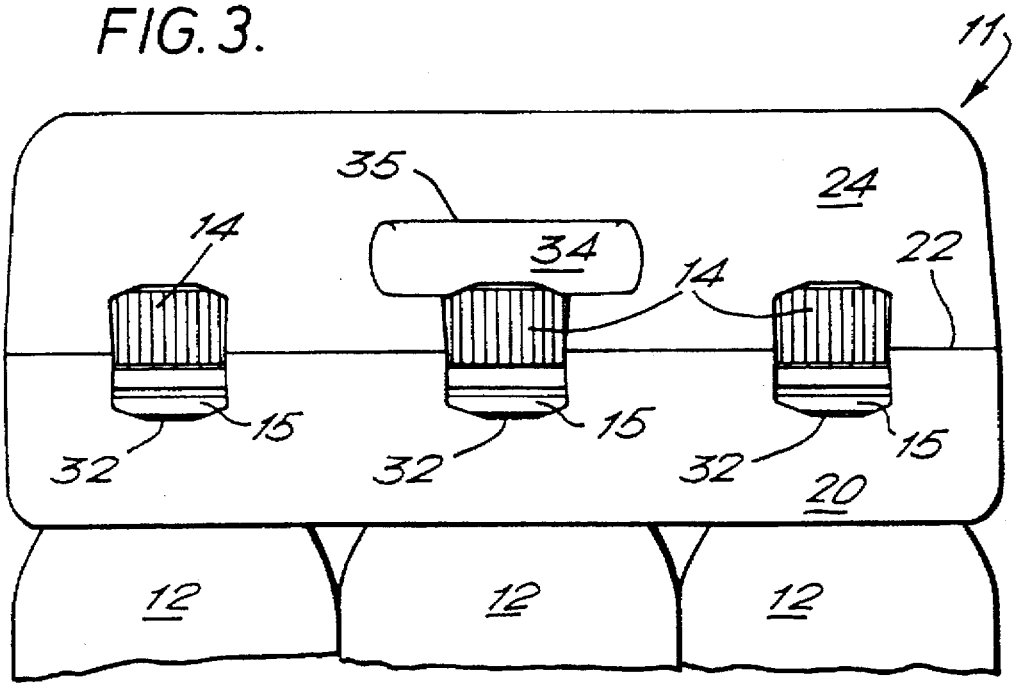
FIG. 3 is a side view of the carrier device of FIG. 2.
Figure 4:
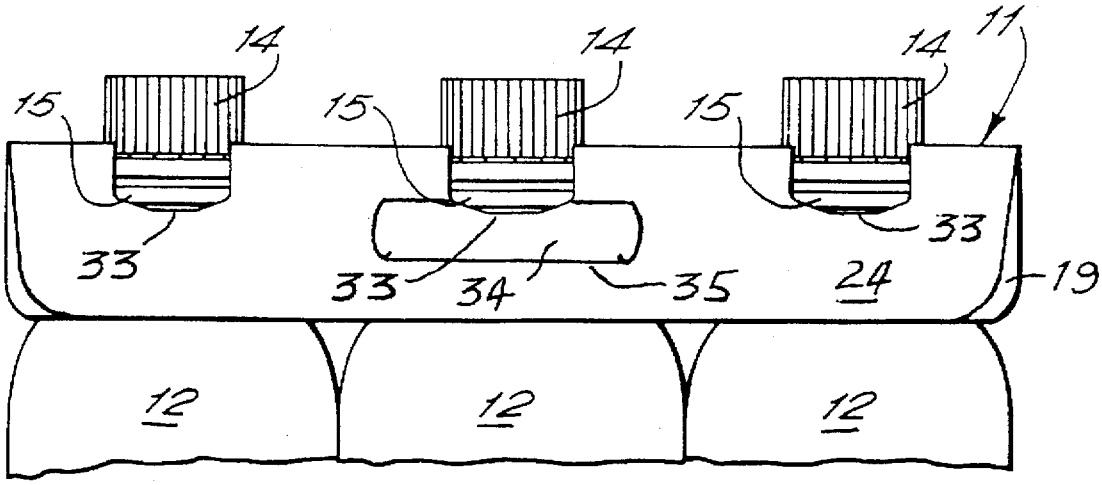
FIG. 4 is a side view of the carrier device of FIG. 2. in an alternate position.

In FIG. 1 there is shown a paperboard blank 10 for producing the carrier device 11 shown in FIGS. 2 to 4. The device 11 is for use in coupling together, in this embodiment, three PET beverage bottles 12, each having a volume of two liters. The device 11 enables three such bottles 12 to be carried as a multipack safely and conveniently. Each bottle 12 has a general neck portion 13, a closure 14 and an annular shoulder 15 just below the closure 14.

The device 11 is made from the paperboard blank 10 and has a base 16 which is hingedly connected at each side edge 17, 18 to a side wall 19, 20 which extend upwardly and towards each other. The side walls 19, 20 are in turn hingedly connected along fold lines 21, 22 to handle portions 23, 24. One handle portion 24 is hingedly connected along fold line 25 to a securing panel 26.

In the base 16 cuts 27 are made to define, in this embodiment six flaps 28 which remain hingedly attached along fold lines 29 and which are generally semi-circular. When the flaps 28 are folded out of the plane of the base 16, generally circular apertures are defined in the base 16.

Holes 31 are also cut out of the blank 10, which holes span the fold lines 21, 22. The holes 31 are generally rectangular, although the edges 32, 33 parallel to the fold lines 21, 22 have their ends angled slightly towards the fold line and the side edges 31*a* are angled upwardly so as to effect a slight waist at the location of fold lines 21, 22. This waisted area tends to grip the closures 14 of the bottles.

Bordering on the upper edge 33 of the central holes are slot like handle elements 34 which are cut from the blank 10, but which remain hingedly attached along fold lines 35.

Arrows 36 show the grain direction of the paperboard and line 37 indicates a fold extending lengthwise of the base.

To assemble the device 11 the two side walls 19, 20 are folded towards each other and a glue line is applied to one of the handle positions 23, 24 just above the respective fold line 21, 22. Another glue line is applied remote from the fold line 21, 22 on either handle portion 23, 24. The handle portions 23, 24 are then stuck together such that fold lines 21, 22 lie next to each other. Glue is also applied to the panel 26 which is folded over and secured to the handle portion 23. The base 16 and side walls 19, 20 therefore form a triangular section attached to a double thickness handle section which has an extra reinforcing thickness (panel 26) above the handle fold lines 35. The fold 37 enables the device 11 to be stored flat when not in use.

The device 11 is applied to a series of three bottles 12 in a very simple manner. Examining the engagement of a single bottle 12 only the device is pushed downwardly over the neck area 13 of the bottles 12. The closure 14 of bottle engages the pair of flaps 28 which are pushed upwards about fold lines 29 so as to lie generally against the side walls 19, 20 such that the uppermost edge of the flaps 28 just protrude above the edges 32 of the holes 31. Further downward movement of the device 11 causes the shoulder 15 to engage the flaps and push past the upper edges of the flaps 28 and the edges 32 so as to be engaged by the device 11 by means of a snap action, the edges engaging firmly below the shoulder 15.

The device is of course dimensioned such that the closure 14 is a neat fit in holes 31, the shoulder 15 is held firmly and the aperture 30 sits on the upper portion of the bottle 12 below the shoulder 15.

In the embodiment shown in FIG. 4 the handle portions 23, 24 have been bent back in one direction about fold lines 21, 22 so as to lie against one of the side walls 19, 20. The handle portions are held in this position by the handle elements 34 which also engage below the shoulder 15 with a snap action, and also by the edges 33 of the holes 31 engaging below the shoulders 15.

Such an arrangement is ideal in a retail outlet for joining bottles into a multipack formation. Product information, advertising or promotions can also be printed on the device as desired. As mentioned the devices can be supplied ready assembled in a flat form for ease of handling.

Alternatively the blank 10 can be applied in a packaging line directly to the bottles. The base would be placed over the bottles such that the flaps engaged below the shoulders, the side walls would be folded in, adhesive applied to the handle portions which are brought together and secured as the lower edges of the holes engage below the shoulders of the bottles.

Figure 5:
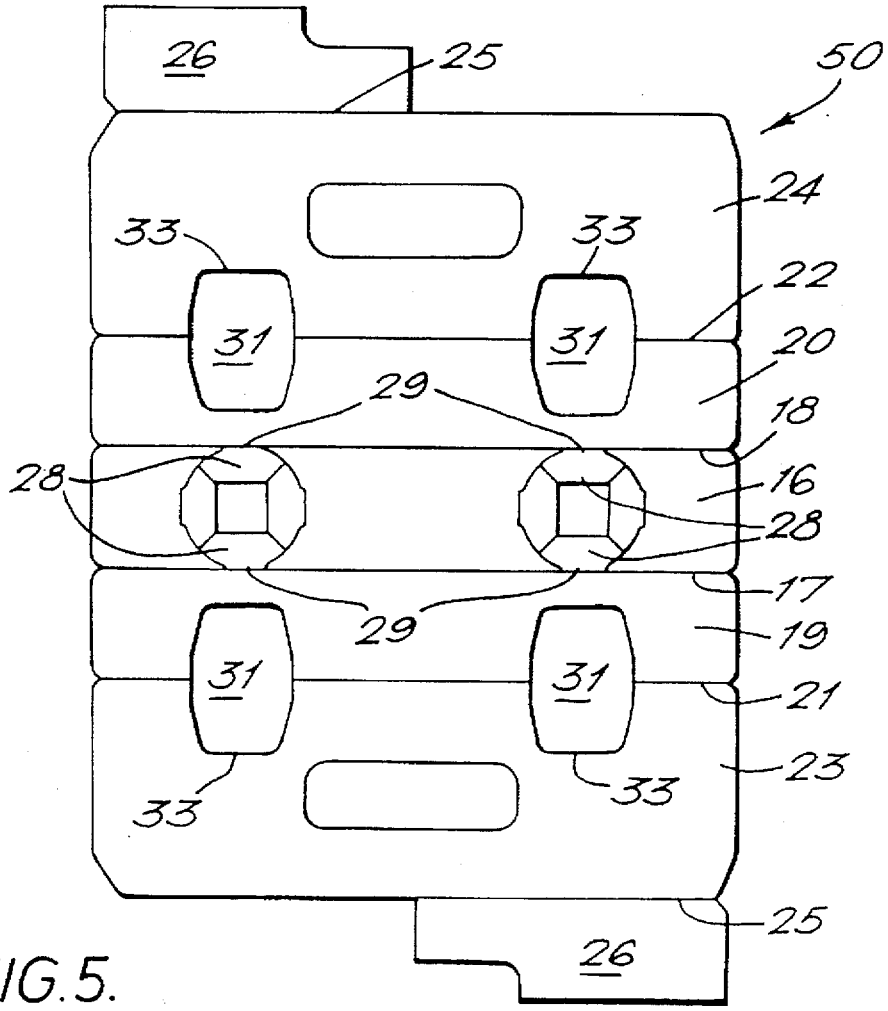
FIG. 5 shows a second embodiment of the carton blank of the present invention.

An alternate embodiment of blank 50 is shown in FIG. 5. Many features of this blank 50 are similar to those of the blank 10 and so have been given like reference numerals. It will be appreciated that the assembly and operation of this device is almost identical to that of FIGS. 1 to 4.

The principle difference is the provision of four flaps 28 for each aperture 30. Also the arrangement illustrated in FIG. 5 is adapted to carry only two bottles. In such an arrangement the engagement of the handle portions in a folded condition beside the side walls is effected solely by the edges 33 of the handle portions 23, 24. This embodiment does not, however, have the fold line 37 in the base to enable flat storage of assembled devices.

It will be appreciated that the above described devices can be adapted for use with any reasonable number of bottles. Also, the term bottles can include glass or PET or other suitable materials and can also include any suitable container having a shoulder which can be engaged in the manner described. The direction of grain indicated is preferred for strength, but with lighter loads and/or thicker paperboard this feature may not be necessary.

In some applications it may not be desirable or necessary to include the handle portions 23, 24. The resulting device would have the form of a triangular sectioned bar linking two or more bottles. Gripping holes could be provided to facilitate lifting or the device could be simply lifted by gripping below the base 16. A suitable securing panel 26 may be hingedly attached to one of the side walls 19, 20.

In all arrangements it is not necessary to use glue to connect the various panels of the device. Interlocking tabs or other formations could be employed to join up the blank to produce the device. This may for example be useful for small production runs.

It will also be appreciated that the generally semi-circular flaps 28 are suitable for bottles having a neck of circular section. However, other shaped flaps 28 and cuts can be used for bottles of different section such as rectangular, hexangonal etc.

While a preferred embodiment of the invention has been disclosed in the foregoing Specification, it is understood by those skilled in the art that variations and modifications thereof can be made without departing from the spirit and scope of the invention, as set forth in the following claims. Moreover, the corresponding structures, materials, acts, and equivalents of means or step plus function elements in the claimed elements are intended to include any structure, material, or acts for preforming the functions in combination with other claimed elements as specifically claimed.

I claim:

1. A carrier device for carrying at least two containers, each container having an annular shoulder projecting from a neck portion, a container cap on the neck portion, and an annular shoulder formed on the neck portion and extending away therefrom, the annular shoulder having opposite side portions, said carrier device being formed from paperboard and comprising:

a base, said base having at least two apertures defined therein for receiving the respective neck portions of the containers therein;

two opposed side walls hingedly connected to said base, each said side wall being angled relative to the base and extending toward the other said side wall from opposite sides of the base;

a cut away portion defined in each said side wall for each respective container so that the opposite side portions of the annular shoulder of each one of the containers is held in a first snap fit between a cooperating pair of said cut-away portions defined in said opposed side walls;

each said aperture being defined at least in part by a pair of oppositely disposed flaps hingedly connected to said base adjacent each of said side walls, respectively, each said flap being folded adjacent each of said side walls, respectively, so that the annular shoulders of the respective containers are held in a second snap fit on each said pair of oppositely disposed flaps;

each of said side walls being hingedly connected to an upwardly projecting handle portion, each said handle portion including a handle means, wherein said cut-away portions extend into each said handle portion for receiving the container caps of the respective containers therein, said handle means being sized and shaped to be folded over and adjacent one of said side walls and to be held on said one side wall in a third snap fit below the annular shoulder of the neck of at least one of the containers.

2. The carrier device as claimed in claim 1, wherein at least a portion of the periphery of each said aperture engages the neck of each respective container.

3. The carrier device as claimed in claim 1, wherein each said aperture is generally circular.

4. The carrier device as claimed in claim 3, wherein each said flap is generally semi-circular and has a straight edge opposite a diametral edge, said straight edge being the hinge line of each said flap.

5. The carrier device as claimed in claim 4, wherein said hinge line is spaced from said diametral edge of each said flap and is so spaced that when each said flap is folded back against each respective one of the side walls, each said flap protrudes above a bottom edge of one of said cut-away portions defined in said side walls of said carrier device.

6. The carrier device as claimed in claim 5, wherein said bottom edge of each said cut-away portion is generally parallel to said side wall in which said bottom edge is defined.

7. The carrier device as claimed in claim 6, wherein the handle portions are glued together immediately above said side walls.

8. The carrier device as claimed in claim 7, wherein a securing flap extends from one of said handle portions, said securing flap being folded over onto the other said handle portion and adhesively secured thereto.

9. The carrier device as claimed in claim 8, wherein said handle means is defined within each said handle portion by cutting out a slot-shaped element in each said handle portion to form a handle aperture in each said handle portion, each said slot-shaped element being hingedly connected to each said handle portion, respectively, along an upper edge defined within each said handle portion, said upper edge being generally parallel to the hinged connection between each said handle portion and the side walls of said carrier device.

10. The carrier device as claimed in claim 9, wherein each said handle aperture is constructed and arranged so that as said handle portions are folded down onto said one of said side walls, each said handle aperture is held in said third snap fit below the annular shoulder of at least one of the containers.

11. The carrier device as claimed in claim 1, wherein said base portion includes a central, lengthwise extending fold so that said carrier device may be collapsed and stored flat.

12. The carrier device as claimed in claim 1, wherein the paperboard of said carrier device extends in a direction generally perpendicular to said side walls.

13. A device for carrying at least two containers, each container having an elongated neck portion, a container cap received on the neck portion, and an annular shoulder formed on the neck portion below the cap, the annular shoulder projecting outwardly from the neck portion of the container and having a top surface facing the container cap and a bottom surface facing away from the container cap, said device comprising:

a base portion, said base portion having at least two apertures defined therein and extending therethrough, each said aperture being sized and shaped to be passed over the neck portion of one of the containers;

a pair of opposed side walls, each said side wall being hingedly connected to a pair of spaced edges of said base portion, said side walls being folded toward one another and angled with respect to said base portion, each said side wall having a cut-away portion defined therein and extending therethrough for each container to be carried by said device, each said cut-away portion being substantially aligned with said cut-away portion defined in the other said side wall and being sized and shaped to receive at least a portion of the annular shoulder of one of the containers therein, each pair of said cut-away portions holding the annular shoulder of one of the containers therein in a first snap fit;

each said aperture within said base portion having at least a pair of opposed flaps formed in said base portion and being hingedly connected to said base portion, each said flap being sized and shaped to be urged into an upwardly inclined position with respect to said base portion as the necks of the containers are passed through said aperture so that each said flap is engaged with the bottom surface of the annular shoulder of one of the containers in a second snap fit;

a pair of opposed handle portions hingedly connected to an edge of each said side wall, said handle portions being fastened to one another and normally extending away from said side walls and said base portion, said cut-away portions of each said side wall extending into said handle portions and being further sized and shaped to receive the container cap on each neck portion of the containers, said handle portions including a common handle hold opening defined therein and extending therethrough;

said handle portions being constructed and arranged to be folded over into a juxtaposed position adjacent one of said side walls so that said handle hold opening is held in a third snap fit on the bottom surface of the annular shoulder of at least one of the containers carried by said device.

14. In a paperboard carrier for carrying at least two containers, each container having an elongated neck portion, a container cap received on the neck portion, and an annular shoulder formed on the neck portion below the cap, the annular shoulder projecting outwardly away from the neck portion of the container and having a top surface facing the container cap and a bottom surface facing away from the container cap, the paperboard carrier having a base portion with at least two apertures defined therein and extending therethrough, each of the apertures being sized and shaped to receive to be passed over the neck portion of one of the containers, a pair of opposed side walls hingedly connected to opposed edges of the base portion, the side walls being folded toward one another and angled with respect to the base portion, each side wall having a cut-away portion defined therein and extending therethrough for each of the containers to be carried by the device, each cut-away portion being substantially aligned with the cut-away portion defined in the other side wall for receiving at least a portion of the annular shoulder of one of the containers therein, each aligned pair of cut-away portions holding the annular shoulder of one of the containers therein, each aperture defined in the base portion having a pair of opposed flaps hingedly connected thereto adjacent each opposed side wall, respectively, each of the flaps being urged into an upward position with respect to the base portion and adjacent one of the side walls of the carrier as the neck of the containers is passed therethrough, the flaps being engaged with the bottom surface of the annular shoulder of the neck portions of the containers, and a pair of opposed handle portions hingedly connected to an edge of one each of the side wall portions, the handle portions being fastened to one another and normally extending away from the side wall portions and the base portion, each of the handle portions including a handle hold opening defined therein and extending therethrough, in which the improvement comprises:

each of the handle portions being constructed and arranged to be folded over together with the other of said handle portions into a juxtaposed position adjacent one of the side walls so that the handle hold opening is held in a snap fit on the bottom surface of the annular shoulder of at least one of the containers carried by said device.

* * * * *